US011927346B1

(12) United States Patent
Disher

(10) Patent No.: US 11,927,346 B1
(45) Date of Patent: Mar. 12, 2024

(54) SYSTEM AND METHOD FOR LIGHTER LOW FUEL INDICATOR

(71) Applicant: Ronnie Ray Disher, Santee, SC (US)

(72) Inventor: Ronnie Ray Disher, Santee, SC (US)

( * ) Notice: Subject to any disclaimer, the term of this patent is extended or adjusted under 35 U.S.C. 154(b) by 0 days.

(21) Appl. No.: 17/984,664

(22) Filed: Nov. 10, 2022

Related U.S. Application Data

(60) Provisional application No. 63/277,744, filed on Nov. 10, 2021.

(51) Int. Cl.
*F23Q 2/16* (2006.01)
*F23N 5/24* (2006.01)
*F23Q 2/42* (2006.01)

(52) U.S. Cl.
CPC ..... *F23Q 2/161* (2013.01); *F23N 5/245* (2013.01); *F23Q 2/42* (2013.01); *F23N 2225/04* (2020.01)

(58) Field of Classification Search
CPC . F23Q 2/161; F23Q 2/42; F23N 5/245; F23N 2225/04
See application file for complete search history.

(56) References Cited

U.S. PATENT DOCUMENTS

| | | | | |
|---|---|---|---|---|
| 2,605,634 | A | 8/1952 | Harold | |
| 3,591,039 | A * | 7/1971 | Hocq | F23Q 2/42 431/89 |
| 4,419,069 | A * | 12/1983 | Piffath | F23Q 2/161 431/89 |
| 6,688,313 | B2 | 2/2004 | Wrenn et al. | |
| 7,160,104 | B2 | 1/2007 | Faber | |
| 2005/0053883 | A1* | 3/2005 | Faber | F23Q 2/32 431/14 |
| 2005/0266365 | A1* | 12/2005 | Xie | F23Q 2/42 431/129 |

* cited by examiner

*Primary Examiner* — Alfred Basichas
(74) *Attorney, Agent, or Firm* — Bold IP, PLLC; Christopher Mayle

(57) ABSTRACT

A improved system and method for a lighter with a sealed compartment for a battery and LED whereby the lighter is designed to be a conventional lighter with a striker that is a standard push button electrical device that creates a spark where the lighter has a pressure fuel flow valve having a spring loaded valve with a gasket to restrict fuel flow such that a pressure indicator is triggered by decreased pressure as a balloon would do to expand as the pressure reducing effect takes place. Once the pressure valve has expanded, it releases the contact whereby a switch is flipped making a complete current thereby turning on a power cell corresponding to an LED light. The light indicates to the user to purchase a new lighter or refill the existing lighter.

14 Claims, 1 Drawing Sheet

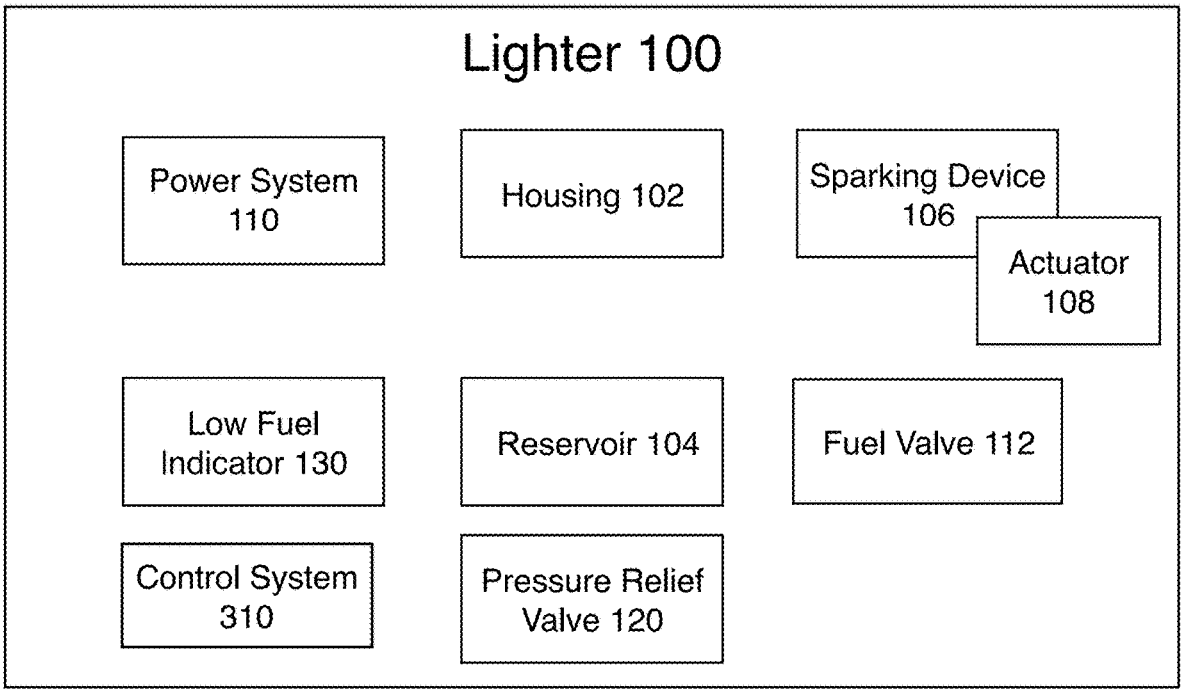
Lighter 100
Power System 110
Housing 102
Sparking Device 106
Actuator 108
Low Fuel Indicator 130
Reservoir 104
Fuel Valve 112
Control System 310
Pressure Relief Valve 120

SYSTEM AND METHOD FOR LIGHTER LOW FUEL INDICATOR

CROSS REFERENCE TO RELATED APPLICATIONS

This application claims priority to U.S. Provisional Patent No. 63/277,744 filed on Nov. 10, 2021, which is incorporated in its entirety.

FIELD OF DISCLOSURE

The overall field of this invention is a system and method for a lighter fuel indicator and more particularly to a lighter fuel indicator with a pressure relief valve that, when a predetermined percentage has been reached, a switch is closed to provide a signal to show the user of the lighter that fuel supply is nearing exhaustion

BACKGROUND

A major problem with the conventional type of liquid-fuel cigarette lighter, which are the most commonly used, is the fact that, as the supply of fuel in the reservoir approaches exhaustion, no change in the operation of the lighter occurs; but suddenly, and without previous warning, the lighter refuses to operate because the supply of fuel is completely exhausted. This could happen in various scenarios that present a wide array of problems such as at a campfire where the lighter is out of fluid and therefore the family will only be able to eat cold snacks, at a lighthouse to direct ships, or when a person just needs to smoke. Thus, there exists the need to provide an indicator which will show to the user of such a lighter the fact that the supply of fuel is nearing exhaustion so that the reservoir may be refilled or replaced before failure of the lighter for lack of fuel.

BRIEF DESCRIPTION OF DRAWINGS

The present invention will be described by way of exemplary embodiments, but not limitations, illustrated in the accompanying drawings in which like references denote similar elements, and in which:

FIG. 1 is a block diagram of the lighter in accordance with the present invention.

SUMMARY

The present disclosure recognizes the unsolved need for an improved system and method for a lighter with a sealed compartment for a battery and LED. The lighter is designed to be a conventional lighter with a striker that is a standard push button electrical device that creates a spark. The lighter has a pressure fuel flow valve having a spring-loaded valve with a gasket to restrict fuel flow. The pressure indicator is triggered by decreased pressure as a balloon would do to expand as the pressure reducing effect takes place. Once the pressure valve has expanded, it releases the contact whereby a switch is flipped making a complete current thereby turning on a power cell corresponding to an LED light. The light indicates to the user to purchase a new lighter or refill the existing lighter.

DETAILED DESCRIPTION

In the Summary above and in this Detailed Description, and the claims below, and in the accompanying drawings, reference is made to particular features of the invention. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skills in the art that the invention may be practiced without these specific details. In other instances, well-known features have not been described in detail to avoid unnecessarily complicating the description.

One non-limiting embodiment of lighter 100 in accordance with the present invention is illustrated in FIG. 1. In this embodiment, lighter 100 may be a cigarette lighter. While the embodiments are directed to a cigarette lighter, numerous other forms of lighters for various utilities may be used to embody the features and operate in accordance with the intent of the present invention.

Lighter 100 may include a power system 110 for providing energy to power a low fuel indicator 130 during the process of operating. Lighter 100 may be powered by methods known by those of ordinary skill in the art. In some embodiments, lighter 100 may plug into an electrical outlet using an electrical cord to supply power. Further, electronic lighter 100 may include a rechargeable battery pack whereby the rechargeable battery is of a charge, design, and capacity to provide sufficient power to the various systems during operation for a set period of time needed. In other embodiments, power system 110 may include one or more disposable batteries. Low fuel indicator 130 may be in the form one or more LED lights or apparatus connected to power system 110 to indicate various statuses such as for a low amount of fuel in reservoir 104.

Lighter 100 includes a housing 102 defining a reservoir 104, whereby reservoir 104 may be filled with a pressurized gas or fuel such as butane where the butane is pressurized and stored, thus turning the butane into a liquid. A sparking device 106 may be positioned on housing 102 outside reservoir 104 to act upon a stone or synthetic pyrophoric alloy such as ferrocerium positioned inside of housing 102. Sparking device 106 may have any number of actuators 108 such as a push button and spin wheel that may be pushed down by an operator to rub against the ferrocerium to activate the spark as well as open the valve to release the butane from reservoir 104. Simultaneously, a fuel valve 112 opens from which the butane is released, which is vaporized (depressurized) as soon as it exits reservoir 104. A spark is produced just above fuel valve 112 and ignites the gas resulting in a flame.

In further non-limiting embodiments, the lighter may have a piezoelectric material that converts mechanical energy to electric energy whereby when the operator presses an actuator the piezoelectric material deforms and bears a current causing an electric discharge from one or more wires to ignite the depressurized butane gas.

Reservoir 104 may have or be connected to a pressure relief valve 120. Pressure relief valve 120 may have a spring-loaded mechanism that will extend when the reservoir's internal pressure drops below a preset threshold. The spring-loaded mechanism may have one or more springs as well as one or more pistons or diaphragms with one or more gaskets to create a seal between the piston and the surrounding cylinder bore the piston is positioned into. The upper end of the piston or diaphragm carries an electrical connector to come in contact with a switch to complete the circuit. In one non-limiting embodiment, the spring expands and exerts a force on the piston or diaphragm and acts to close the circuit by triggering a switch. The pressure relief valve 120 may be designed to be adjustable, which allows the operator to adjust the pressure set-point by changing the force exerted by the spring.

In operation of one non-limiting embodiment, when the switch is closed, an indicator, such as low fuel indicator 130 may be energized. In other embodiments, low fuel indicator 130 may be a light, bell, buzzer, computer display, or other alarm. When the pressure in the reservoir is above a predetermined minimum, the total force exerted on the piston is sufficient to move against the combined force of the spring. As the piston and the electrical connector move away from the switch, the indicator circuit is broken to stop the energization of low fuel indicator 130. Whenever the pressure falls below a predetermined amount of pressure signifying a low amount of fuel in the reservoir, the electrical connector of the piston may be moved by the spring to the position where the switch is located to complete the indicator circuit and energize low fuel indicator 130 once again.

In further non-limiting embodiments, lighter 100 may have a control system 310 connected to the power system 110 with one or more computing devices whereby the circuit may be activated sooner, such as around when the fuel level is at 50%. As the fuel is decreasing, the control system may compare the fuel amount value taken out from a fuel amount measurement report message using one or more fuel amount tables. Control system 310 may then convert the report message into easily understandable messages like half for 50%, quarter for 25%, a little left for 10%, and empty at 5% and display these messages on a display. Notifications may also be presented as words, numbers, drawings, emojis, or other symbols.

Control system 310 may have a series of computing devices. Control system 310 may be in the form of a circuit board, a memory or other non-transient storage medium in which computer-readable coded instructions are stored and one or more processors configured to execute the instructions stored in the memory. Control system 310 may have a wireless transmitter, a wireless receiver, and a related computer process executing on the processors.

Computing devices of control system 310, may be any type of computing device that typically operates under the control of one or more operating systems, which control scheduling of tasks and access to system resources. Computing devices may be a Raspberry Pi® or other computing devices such as but not limited to a phone, tablet, television, desktop computer, laptop computer, gaming system, wearable device electronic glasses, networked router, networked switch, networked, bridge, or any computing device capable of executing instructions with sufficient processor power and memory capacity to perform operations of control system 310. In other non-limiting embodiments control system 310 may have a communication interface such that control system 310 may communicate with external devices such as a phone or tablet where the fuel is indicated on the external devices.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A lighter comprising:

a pressure relief valve; and a housing having a reservoir configured to be filled with a pressurized fuel, wherein the pressure relief valve is connected to the reservoir, wherein the pressure relief valve has a spring-loaded mechanism that extends when internal pressure of the reservoir drops below a preset threshold signifying a low amount of the pressurized fuel in the reservoir.

2. The lighter of claim 1 further comprising:

a switch, wherein when the pressure relief valve expands, a contact is released, and the switch is flipped, making a complete current.

3. The lighter of claim 2 further comprising:

a power cell corresponding to a low fuel indicator, wherein once the switch is flipped, the low fuel indicator is turned on.

4. The lighter of claim 3 further comprising:

wherein the low fuel indicator is an LED light.

5. The lighter of claim 3, wherein the pressure relief valve is adjustable permitting an operator to adjust a pressure set-point by changing a force exerted by a spring in the spring-loaded mechanism.

6. The lighter of claim 5, wherein the low fuel indicator is a bell.

7. The lighter of claim 5, wherein the low fuel indicator is a computer display.

8. The lighter of claim 5, wherein the low fuel indicator is a buzzer.

9. A lighter comprising:

a reservoir;

a pressure relief valve, wherein the pressure relief valve has a spring-loaded mechanism that extends when an internal pressure of the reservoir drops below a preset threshold signifying a low amount of pressurized fuel in the reservoir;

a switch, wherein when the pressure relief valve expands, a contact is released, and the switch is flipped, making a complete current in a circuit; and a power system with a power cell corresponding to a low fuel indicator, wherein once the switch is flipped, the low fuel indicator is turned on.

10. The lighter of claim 9, wherein the low fuel indicator is an LED light.

11. The lighter of claim 9, wherein the pressure relief valve is adjustable permitting an operator to adjust a pressure set-point by changing a force exerted by a spring in the spring-loaded mechanism.

12. The lighter of claim 9, further comprising a control system connected to the power system with one or more computing devices.

13. The lighter of claim 12, wherein the control system compares an amount of the pressurized fuel taken out to a report message using one or more fuel amount tables, wherein the control system then converts the report message into one or more messages on a display.

14. The lighter of claim 9, wherein the spring-loaded mechanism has one or more springs, a piston or diaphragm with one or more gaskets to create a seal between the piston and a surrounding cylinder bore the piston is positioned into, wherein an upper end of the piston or the diaphragm carries an electrical connector to come in contact with the switch to complete the circuit, wherein the one or more springs expands and exerts a force on the piston or the diaphragm and acts to close the circuit by triggering the switch.

* * * * *